US006822930B2

(12) United States Patent
Falgout, Sr

(10) Patent No.: US 6,822,930 B2
(45) Date of Patent: Nov. 23, 2004

(54) MOTOR RUN TIMER

(76) Inventor: Thomas E. Falgout, Sr, 110 Charles Read St., Lafayette, LA (US) 70503

( * ) Notice: Subject to any disclaimer, the term of this patent is extended or adjusted under 35 U.S.C. 154(b) by 485 days.

(21) Appl. No.: 09/892,682

(22) Filed: Jun. 28, 2001

(65) Prior Publication Data

US 2003/0161218 A1 Aug. 28, 2003

(51) Int. Cl.[7] ..... G04F 8/00; G04F 10/00

(52) U.S. Cl. ..... 368/1; 368/5; 368/8; 368/9; 368/110

(58) Field of Search ..... 368/1, 5–10, 107, 368/110, 113

(56) References Cited

U.S. PATENT DOCUMENTS 1,262,040 A * 4/1918 Hall ..... 235/104
2,051,502 A * 8/1936 Swigert ..... 368/8
2,325,312 A * 7/1943 Follender ..... 368/8
3,479,815 A * 11/1969 Prindell ..... 368/8
3,965,669 A * 6/1976 Larson et al. ..... 368/9
5,003,518 A * 3/1991 Felder ..... 368/5

* cited by examiner

*Primary Examiner*—Vit W. Miska
(74) *Attorney, Agent, or Firm*—John D. Jeter

(57) ABSTRACT

A timer is enclosed in a pressure tight enclosure which is attached to or is part of the motor rotor. Rotation of the rotor is sensed and the timer is turned on when the rotor is turning and is turned off when the rotor is idle. The version usable in motors of the progressing cavity type can power the timer, and provide timer control.

7 Claims, 1 Drawing Sheet

MOTOR RUN TIMER

This invention pertains to motors used down hole in well drilling operations. More particularly it is related to run time totalisers that indicate the amount of time a motor has been actually rotating.

BACKGROUND OF INVENTION

Mud powered motors are used extensively in the well drilling industry, usually to drive drill heads. They are often leased on the basis of rotating hours. When the motor is down hole on a drill string, it may be idle while various non-drilling activities take place. Records are usually kept of such intervals but that is not always the case. A recorder is needed that places no clerical burdens upon the drilling activity but does record the total time of motor operation. Turbines are used to drive apparatus down hole, including a drill head. Positive displacement motors now operating are usually of the progressing cavity type. Progressing cavity motors have rotors with lobes that progress around the stator which usually has one more cavity than the rotor has lobes. The rotor rotational axis progresses around the stator centerline at a rate that is equal to the rotor rpm times the number of stator cavities. The rotor rotation is in a direction opposite that of the orbital movement. In an eight-cavity stator, a rotor turning clockwise at two hundred rpm has a center line orbiting the stator center line at sixteen hundred times per minute counter clockwise. The diameter of the orbit may be about three-quarters of an inch on a commonly used motor.

Users of down hole drilling motors often require that the rotor be topped by a security flange to aid in recovery in case of disruptive failure of motor or drill string components. The flange atop the rotor places an unusual demand upon any contrivances or instruments connected to the rotor.

Operations down hole involve very high hydrostatic pressures and the temperature commonly approaches three hundred degrees Fahrenheit. Only specialized electric storage batteries can operate at that temperature. Few batteries or instruments can operate at the hydrostatic pressure, and further limitations apply to instruments and batteries. There is a need for a time recorder that does not rely upon batteries and that can be sealed from the pressure.

SUMMARY OF THE INVENTION

A housing is connected to the motor rotor shaft, ideally at the top end, to carry a timer. The timer is preferably a chronograph with associated features that at least turn it on and off in coordination with starting and stopping of motor rotation. On progressing cavity motors with rotor shafts with center lines that orbit the motor housing center lines, a horizontal pendulum free to rotate around the rotor axis will tend to remain in a situation with the pendulum mass farthest from the housing center line. As long as the pendulum is allowed to rotate around the rotor axis, and is forced to a deflected state, it can produce torque to power a timer. The torque is used to start and stop the timer in response to starting and stopping of the motor.

The term pendulum is normally associated with a suspended mass that responds to the acceleration of gravity with the mass tending to return to a line that includes its suspension point and is the gravity vector. In this disclosure, the mass is situated to respond to the acceleration vector related to rotation. The point of suspension rotates relative to the acceleration vector produced by rotation. When the mass is displaced from the acceleration vector, it tends to return and can produce torque. The rotation of the suspension point, with the torque, provides power.

The general description assumes a motor with a vertical axis. Drilling motors may be used off vertical, even horizontal. The vertical assumption aids description but is not to be construed as limitation.

The clock winding action can function as a run timer if very little spring energy is stored by a clock spring. Further, if input torque from the pendulum is sufficiently regulated, no clock spring is needed. Run time, then, is simply the elapsed time indicated by the clock. The ordinary clock is set up for twelve hours, then repeats. Motors may run several hundred hours and a clock read out can be geared to produce units, tens, hundreds and thousands of hours.

Alternatively, sufficient power can be stored in a selected clock spring to run one thousand hours and no winding during a common motor run is needed. Starting and stopping the clock in response to motor starting and stopping is then needed. The pendulum, in that case, can be used to perform the clock control function.

The preferred embodiment for a positive displacement motor uses the pendulum for running the time recording function with no need for an energy storing spring. For turbine related timing, centrifugal force responsive elements can turn the timer on and off. The full-run, timer-powering, spring is then preferred, and is usable on the positive displacement motors. The centrifugal switch used herein for clock control can operate if the motor is any degree off vertical.

Starting and stopping of clock work is commonly practiced, mostly on watches. Such controls usually interfere with the escapement mechanism during the stop interval, and the timing starts when the interference is removed. The pendulum can rotate constantly and produce torque to move an element that stops and starts the escapement mechanism. The arrangement would stop the clockwork in the absence of torque produced by the pendulum.

When the motor is to be used in circumstances under which battery powered timers can function, the contrivance used to turn on a timer will operate a switch in the battery power circuit.

It is an object of this invention to provide a timer that will run only when the motor runs, and provide read-out as a total of run time.

It is another object of this invention to provide a run time totalizer that is powered by apparatus that senses the orbital movement of the rotor centerline about the motor housing centerline.

It is yet another object of the invention to provide a spring powered time totalizer that is stopped and started in accordance with the stopping and starting of the motor These and other objects, advantages, and features of this invention will be apparent to those skilled in the art from a consideration of this specification, including the attached claims and appended claims.

BRIEF DESCRIPTION OF DRAWINGS

In the drawings wherein like captions refer to like features.

DETAILED DESCRIPTION OF DRAWINGS

Figure 1:
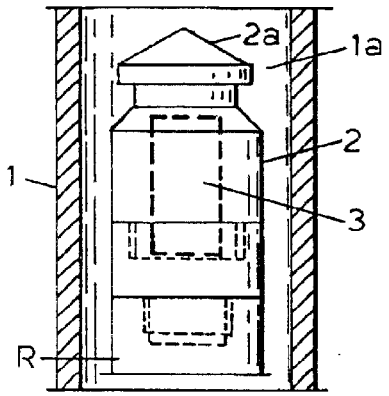
FIG. 1 is a side view, partly cut away, of the preferred embodiment, typically situated.

In FIG. 1, a preferred embodiment for use on positive displacement motors has motor body 1 with timer housing 2 situated in the bore 1*a*, attached to the top of motor rotor R, housing the clock and control assembly 3. Motor body 1 is effectively part of the drill string, with means (not shown) for attachment to an upwardly continuing drill string element above, and a motor below. Rotor R, as part of the motor is bearingly supported in the motor below (not shown) for rotation therein. If the motor is a turbine, the rotor axis of rotation stays on the motor body centerline. If a progressing cavity positive displacement motor is in use the rotor centerline is displaced form the body centerline and orbits the body centerline while the rotor rotates.

Figure 6:
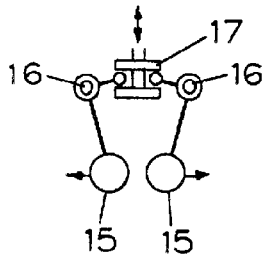
FIG. 6 is an elevation of a form of a fly ball governor clock control for use with a prewound clock spring, or other source of power to run the timer.

For service in a turbine motor, housing 2 will contain a spring powered clock controlled by the apparatus of FIG. 6. That arrangement will also work in a positive displacement motor.

The enlargement 2*a* is a typical security arrangement of motor rotors to recover the rotor if the motor comes apart down hole. In use, the motor body has a reduced diameter (not shown) to run below the flange 2*a*. That feature is not part of the invention but is included in the housing if needed.

Figure 3:
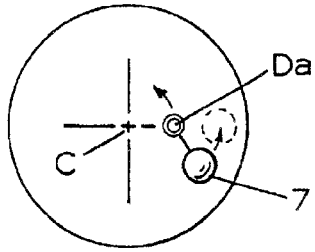
FIG. 3 is similar to FIG. 2 but more hardware specific related to the function of a clock driving and controlling arrangement.
Figure 4:
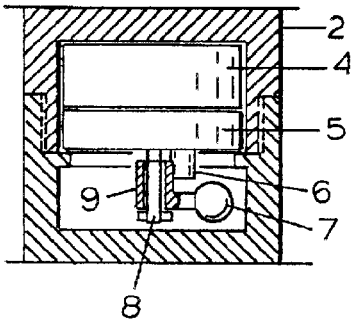
FIG. 4 is a side view of the embodiment of FIG. 1, rather enlarged, further cut away, showing the relationships of preferred elements.
Figure 5:
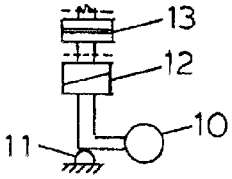
FIG. 5 is an elevation showing specific functional elements common to the enclosures of FIG. 4.

For use in a positive displacement motor, housing 2 may contain the apparatus of FIG. 4. Details of the physical principles that make the apparatus of FIG. 4 function are shown in FIGS. 2, 3 and 5.

Figure 2:
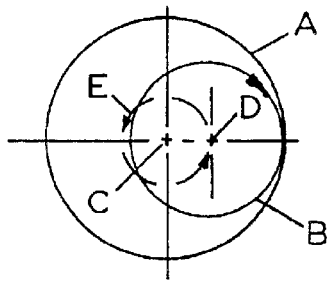
FIG. 2 is a diagrammatic presentation of the geometry that causes one centerline to orbit another.

In FIG. 2, schematic features include the bore of the motor stator A, the external surfaces of rotor B, which rolls counter clockwise around the stator bore. Rotor centerline D orbits motor body centerline C, along path E In FIG. 3, more hardware related, shaft Da is on the rotor centerline and carries pendulum 7. Pendulum 7 is free to rotate about Da which rotates about body centerline C. Pendulum 7 tends to move to the dotted position at a maximum distance from C. At the displaced position shown, it will deliver torque to pinion 6 of FIG. 4. With a rotor rotating clockwise, for instance, at two hundred rpm in an eight lobe stator, shaft Da is rotating two hundred rpm clockwise and the pendulum, held in the relative position shown, rotates at sixteen hundred rpm counter clockwise. The pendulum, then, rotates about the shaft at eighteen hundred rpm relative.

Referring now to FIG. 4, pendulum 7, carried by geared hub 9, rotating about shaft 8, delivers power to gearbox 5 which powers clock 4. If there is no, or minimal, clock spring there is no need for an on-off control. The clock stops running when pendulum 7 quits turning. It quits turning when the motor stops.

If a significant clock spring is used, an on-off switch is needed. The apparatus of FIG. 5 provides means to turn the clock on and off. With the pendulum 10 (or 7) a slip clutch 13 is used. Cam lift 12 moves the upper part of the apparatus when torque is being delivered. That up and down movement turns the clock on or off. Linkage for that function depends upon the structure of the clockworks used and is within the capability of those skilled in the art.

From the foregoing, it will be seen that this invention is one well adapted to attain all of the ends and objects hereinabove set forth, together with other advantages which are obvious and which are inherent to the apparatus.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

I claim:

1. A motor run-time totalizer, responsive to the rotation of an associated motor, having a rotor, to indicate the amount of time the rotor has been rotating, the apparatus comprising:

a) a housing arranged for attachment to the rotor b) a timer, in said housing, that will indicate the total accumulated run time that occurs while it is turned on;

c) a sensor means, in said housing, to sense the rotation of the rotor and to turn the timer on when the motor is running and turn it off when the motor is not running said sensor is a pendulum free to rotate about the axis of the rotor, the rotation of the pendulum relative to the rotor axis being sensed to start and stop said timer.

2. The apparatus of claim 1 wherein said timer is a spring powered chronograph.

3. The apparatus of claim 1 wherein the rotation of the pendulum moves a movement conducting element to start and stop the time accumulation by said timer.

4. The apparatus of claim 1 wherein the rotor axis orbits the centerline of said motor, said sensor being a pendulum free to rotate about said axis, power to drive said timer being extracted from the rotation of said pendulum relative to said rotor axis.

5. The apparatus of claim 4 wherein said power to drive said timer is delivered to a spring arranged to drive said timer.

6. The apparatus of claim 4 wherein said power to drive said timer is delivered to said timer through a slip clutch arranged such that when the pendulum ceases to deliver said power the timer stops running.

7. The apparatus of claim 1 wherein said timer is battery powered, said sensor arranged to switch the timer on and off.

* * * * *